United States Patent [19]

Porsfeld

[11] Patent Number: 4,577,613

[45] Date of Patent: Mar. 25, 1986

[54] PAVEMENT AND MASONRY STONE CUTTER

[76] Inventor: Friedhelm Porsfeld, Spitalhofstr. 86, 8390 Passau, Fed. Rep. of Germany

[21] Appl. No.: 668,869

[22] Filed: Nov. 6, 1984

Related U.S. Application Data

[63] Continuation-in-part of Ser. No. 378,490, May 14, 1982, abandoned.

[30] Foreign Application Priority Data

May 18, 1981 [DE] Fed. Rep. of Germany ..... 3119693
May 18, 1981 [DE] Fed. Rep. of Germany ..... 3119694

[51] Int. Cl.[4] ..... B28D 1/32
[52] U.S. Cl. ..... 125/23 C; 83/157
[58] Field of Search ..... 125/23 R, 23 C; 83/157

[56] References Cited

U.S. PATENT DOCUMENTS

| | | | |
|---|---|---|---|
| 1,919,801 | 7/1933 | Newson | 125/23 R |
| 2,514,352 | 7/1950 | Solomito | 125/23 R |
| 2,679,840 | 1/1954 | VanLoon | 125/23 C |
| 2,746,447 | 5/1956 | Petch | 125/23 R |
| 2,768,620 | 10/1956 | Jenkins | 125/23 R |
| 2,779,324 | 1/1957 | Schlough | 125/23 C |
| 3,161,190 | 12/1964 | Stephens | 125/23 R |
| 3,559,631 | 2/1971 | Mangis | 125/23 C |
| 4,203,414 | 5/1980 | McClain | 125/23 C |

FOREIGN PATENT DOCUMENTS

| | | | |
|---|---|---|---|
| 2550478 | 5/1977 | Fed. Rep. of Germany | 83/157 |

*Primary Examiner*—Harold D. Whitehead
*Attorney, Agent, or Firm*—Cushman, Darby & Cushman

[57] ABSTRACT

A pavement and masonry stone cutter includes an upper tool supported for vertical up and down movements and which is mounted in an approximately C-shaped frame above a support table for the stone material to be cut; a lower tool is disposed below the support table and is associated with the upper tool with the lower tool passing through an opening in the support table so that the upper tool and the lower tool enter into cutting operation at the same time for precise splitting; a support table during splitting is lowered in a controlled manner with respect to the lower tool; the upper and lower tools may be in the form of individual cleaving wedges which are hydraulically operated to move towards and away from one another; the chambers for the hydraulic cylinders are in fluid communication.

19 Claims, 9 Drawing Figures

PAVEMENT AND MASONRY STONE CUTTER

This is a continuation-in-part application of Ser. No. 378,490, filed May 14, 1982 and now abandoned.

The invention relates to a pavement and masonry stone cutter, comprising an upper tool driven so as to oscillate in a frame and cooperating with a lower tool, the upper and lower tools each comprising a plurality of individual cleaving wedges which are movable relative to one another in cutting direction and supported hydraulically. Furthermore, the instant invention is concerned particularly with the development of the upper and lower tools.

In most quarries particularly granite quarries work is being done with dropping wedges which have been known for decades and are used much in the way of sledge hammers. These cutting or splitting means cause a lot of noise and take up very much space, especially so in height. Besides, they pose a serious health problem and may hurt workers. People working with such tools most often suffer the loss of a finger or two. Moreover, these cleaving devices produce a lot of dust.

The dangerous character and disadvantageous effect of the known cutters for those working with them had been recognized early by those skilled in the art. Therefore, the demand for a replacement of the known cutting implements by much less dangerous and quieter apparatus producing less dust, existed practically from the beginning.

This demand led to developments such as described, among others in U.S. Pat. No. 4,203,414. The stone cutting apparatus disclosed in that publication, however, comprises an extremely complicated positioning means for the rock to be cut between the upper and lower cleaving wedges. The positioning means includes stationary fingers and fingers which are movable vertically and horizontally as well as lateral centering means. The positioning fingers serve to slightly lift the rock supplied by a conveyor in order to carry it between the lower and upper cleaving wedges. the known cutting apparatus requires the provision of such a measure as a supporting table is missing which might serve as thrust means. This is also the reason why the lateral centering means is needed.

The known means for positioning and supporting the rock to be cut is entirely unsuited for manual operation which is the rule in smaller quarries. It would be difficult indeed to place the rock to be cut on the positioning fingers by hand. Moreover, there would be a risk that the cut blocks of stone would fall down and hurt the operator. Finally, it could not be guaranteed that the rock to be cut would be held in the desired position on the positioning fingers. Erroneous cutting and chipping would be inevitable.

U.S. Pat. No. 3,161,190 discloses a manually operated brick cutting apparatus, comprising a supporting table which is supported by springs and has a slot-like passage for a lower cutting or splitting tool. As cleaving forces can be applied to a limited extent only, this apparatus is suitable only for material which is relatively easy to be cut (soft material). With cleaving forces of about 35 to 50 tons, as applied in the cutting of granite rock the spring support of the supporting table not only would be impracticable but even dangerous. The elasticities released upon cutting and inherent in the supporting springs would cause stone blocks to be thrown up and away thus posing an even greater problem of hurting the people at work.

The resilient support of the supporting table is disadvantageous also for stones which vary greatly in shape because the uneven loading would give the table an uncontrolled inclination which will result in an undesired rupture surface.

It is, therefore, the object of the instant invention to provide a cutter of the kind specified initially which is very easy to operate, especially without any risk and which, at the same time, warrants that the desired rupture surface is obtained even if the rock to be cut is of very uneven shape.

This object ist met in surprisingly simple manner by the fact that the frame is C-shaped and supports a supporting table, including a slot-like opening for passage of the lower tool, so as to be resiliently movable in cutting direction, the supporting table proper being so supported by means of hydraulically, pneumatically, or hydropneumatically controlled piston and cylinder units that it moves down during the cutting of stone material and moves up again into its upper starting position, after the cutting, in accordance with the return movement of the upper tool until the lower tool is positioned below the top of the supporting table.

The per se known C-shaped design of the frame makes access to the "cutting range" of the apparatus much easier. The upper and lower tools are readily accessible from three sides. The working space of the operator standing in front of the machine is not obstructed by any parts of the apparatus.

The arrangement of a plane supporting table above the lower tool permits good and safe positioning of the rock to be cut between the upper and lower tools.

The support in accordance with the invention of the supporting table, namely by hydraulically, pneumatically, or hydropneumatically controlled piston and cylinder units such that the supporting table moves down during the cutting of the stone material and moves up again, after the cutting, in accordance with the return movement of the upper tool into its upper starting position so that the lower tool will come to lie below the top or supporting surface of the supporting table is very important.

Controlled cutting is obtain regardless of the
shape of the stone to be cut and of the
weight or distribution of the weight of the stone to be cut, thanks to the control of the up and down movements of the supporting table in accordance with the invention.

Controlled parallel lowering of the supporting table during the cutting process is warranted even if the stone is of very uneven shape and, therefore, of very unevenly distributed weight. The desired rupture surface is guaranteed. The controlled lowering of the supporting table is independent also of the weight of the stone to be cut. If the weight of stones varies greatly, for instance, mere deactivation of the hydraulic supporting elements would involve the risk that the table would sink prematurely if the stones were very heavy, so that the cutting process would be uncontrolled. In that case the stone to be cut would tilt towards one side over the lower tool projecting through the opening in the supporting table before the upper tool enters into engagement. The invention substantially provides for the lowering of the supporting table only under the pressure acting on the stone from the upper tool.

Finally, the support provided by the invention of the supporting table avoids the release of elasticities after the cutting which would cause blocks of stone to be propelled into the air and thus posing a great risk to hurt the operator. In this context it should be kept in mind that apparatus of the kind of the invention operate at cleaving forces of about 40 to 50 tons.

In conclusion, the cutting apparatus according to the invention may be said to be a machine which is very easy to handle without any risk and which guarantees good cutting efficiency also when operated manually and even if the stones vary greatly in weight and shape or weight distribution.

Preferably, the cutting apparatus is actuated by a foot switch so that the operator may use both hands to position the stone material to be cut. During the cutting itself the stone material no longer need be held by hand. The predetermined position of the stone material to be cut is maintained by virtue of the design of apparatus according to the invention. Preferred structural developments of the invention are recited in the sub-claims.

With the embodiment of the invention the pivoting motion of the working table may be so directed and controlled that, after cutting, the cut stone material automatically slides from the working table, for example, into a collecting receptacle or carriage located behind the apparatus.

Precise cutting is achieved because the solution proposed by the invention places the stone material to be cut under simultaneous control of the action of the upper tool as well as the lower tool.

Preferably, the upper tool and/or the lower tool are designed to yield in the direction of the force of reaction acting on the same, if it should surpas a certain limit. This measure is to avoid breakage of the tools or individual cleaving wedges if the reaction forces become too great. If the cutting tool is driven hydraulically, this problem may be solved in a simple manner by providing a throttle valve in the outlet of the hydraulic system and having this valve in open position during cutting. The throttle valve is moved into closed position for return motion of the cutting tool which is driven in oscillating manner.

If the cutting tool is driven hydraulically and a sudden overproportional pressure rise (overloading) is determined, preferably the immediate return stroke is initiated. Moreover, in case of a hydraulic drive, the return stroke of the cutting tool preferably is initiated whenever the pressure in the hydraulic drive system drops suddenly (stone material is cut!).

Of very special importance is the inventive design of the cutting tool which may be applied or used even independently of the cutting apparatus described above.

The further development of the cutting tool according to the invention starts from the stone cutting tool known from French Pat. No. 1 448 921, comprising a tool holder in which a plurality of individual cleaving wedges disposed in a row are arranged so as to be movable relative to one another, the individual cleaving wedges each being supported for displacement in a cylinder chamber filled with an uncompressible medium (oil) and the cylinder chambers being interconnected in fluid communication.

The desired effect of this measure is that displacing one cleaving wedge is to cause a displacement of the other cleaving wedge or wedges in opposite direction. In this manner it is to be avoided that only part of the cutting tool will become effective on uneven stone surfaces, while the greater part of the cutting tool remains hanging in the air.

It is a disadvantage of the known structure according to French Pat. No. 1 448 921 that:

the cylinder chambers are formed by blind bores having a plane base, which are very expensive to produce.

By comparison, the cylinder chambers of the structure according to the invention as presented herein are through bores which can be produced easily and subjected to simple surface treatment (honing). The cylinder chambers designed in accordance with the invention are closed at the side opposite the cleaving edges by a separate cylinder head, in the manner known, for example, from engine construction.

The effect of the fluid communication between the individual cylinder chambers is very dubious in the structure known from French Pat. No. 1 448 921. The connecting passage is surprisingly small so that only small flow rates of fluid can pass from one cylinder chamber to the other during a short period of time. Therefore, the known tool does not permit spontaneous mutual relative displacement of the individual cleaving wedges. This means that a relatively long period of time is needed to adapt the individual cleaving wedges to the surface structure of the stone to be cut. This adaptation of the surface structure, however, must be accomplished before the upper tool and/or the lower tool may be pressurized by high pressure so as to split the stone because only complete adaptation of the individual cleaving wedges to the surface structure of the stone to be split will guarantee uniform loading of the individual cleaving wedges and pressurizing of the stone and, consequently, provide a smooth rupture surface. Thus the known cutting tool needs to be operated in two steps. The working cycle must be interrupted for adaptation of the individual cleaving wedges to the surface structure of the stone to be split.

The fluid balance between the individual cylinder chambers, moreover, is throttled considerably because admission to the connecting passages between the individual cylinder chambers is reduced considerably by a collar as the piston approaches the upper end position in the embodiment shown in FIG. 3 of French Pat. No. 1 448 921. In practical operation, therefore, the piston associated with each individual cleaving wedge will never hit against the front end limitation of the cylinder chamber. For this reason the known solution, of course, lacks the additional impact peak enhancing the cutting effect of the tool.

In practice, the workman pushes a stone to be cut from the freely accessible side between the upper and lower tool. As a rule, it is sufficient to push the stone only so far between the upper and lower tools that one or two cleaving wedges will become effective. This is sufficient, for example, to cut granite stone. The highly throttled fluid communication between the individual cylinder chambers of the known structure explained above would cause an intolerably long time to pass before the outer cleaving wedge or wedges would enter into mechanical contact with the front end limit of the associated cylinder chambers so as to become effective under high pressurization. Yet if this mechanical contact would not be waited for, the cutting would be greatly dampened and, consequently, be much less effective. Also the return movement of the individual cleaving wedges is throttled to a great extent and, therefore, takes relatively long (limited operating speed!).

As compared to that the cutting tool according to the invention as presented herein is of much simpler and more effective structure.

As explained above, the manufacture of continuous cylinder bores to provide fluid-filled cylinder chambers is much easier, particularly so as regards the necessary surface treatment of the cylinder wall.

The groove provided in accordance with the invention at the side of the cylinder head facing the cylinder chambers is of very great importance as it guarantees a "spontaneously effective fluid connection". Of course, the cross section of this groove is so dimensioned as to provide the sponetaneously effective fluid communication.

For this reason fluid displacement problems in adapating the individual cleaving wedges to the surface structure of the stone to be cut are unknown with the structure according to the invention. The adaptation of the cleaving wedges is spontaneous and no interruption of the working cycle is required.

The structure according to the invention is particularly effective if only one or two cleaving wedges become active because they enter into mechanical contact with the tool holder practically without any delay so that an undampened cutting effect is obtained which is accelerated in addition by the mechanical contact between the active cleaving wedges and the tool holder.

In the case of the structural embodiment according to claim 18 the groove interconnects two cylinder chambers disposed in parallel, this double cylinder arrangement permitting the system pressure to be cut in half (about 150 bar) at unchanged maximum cutting force (about 40 tons or 310 bar). Thus the double cylinder arrangement has the advantage that smaller dimensions are required for the hydraulic system, thus causing less sealing problems.

The structural further development comprising a double cylinder row thus affords an effective combination of the advantages regarding the dimensioning of the hydraulic system and the advantages described above in greater detail which are provided by the groove constituting the fluid connection between the individual cylinder chambers.

U.S. Pat. No. 4,203,414 mentioned initially also shows the individual cleaving wedges of the upper and lower tools to be in fluid communication, yet this is not a direct connection but a connection effected by way of electro-hydraulic valves. These valves are needed for the two stage method of operation aimed at by U.S. Pat. No. 4,203,414. At first, the cleaving wedges are moved slowly and under low pressure towards the stone to be cut so that they can adapt automatically to the surface outline of the stone to be cut. Thereupon the individual cleaving wedges are blocked in their relative position by closing solenoids associated with the above mentioned valves. To cut the stone, the blocked individual cleaving wedges are subjected to high pressure by moving the cleaving wedge yokes towards each other (cf. column 1, line 49 et seqq., column 18, line 4 et seqq., and column 12, line 55 et seqq. of U.S. Pat. No. 4,203,414).

Thus the known hydraulic system is not comparable with the fluid connection between the individual cleaving wedges provided by the invention.

The structural further development as recited in claim 23 largely avoids any damages of the cutting tool by stone material left behind. Furthermore, this measure reduces the risk of operators becoming hurt by blocks of stone chipping off under the sharp edges of the cutting tool. Having a wedge-shaped underside, the tool holder presents a kind of continuation of the cutting tool or cleaving wedge.

The invention will be described further, by way of a preferred embodiment, with reference to the accompanying drawings, in which:

Figure 1:
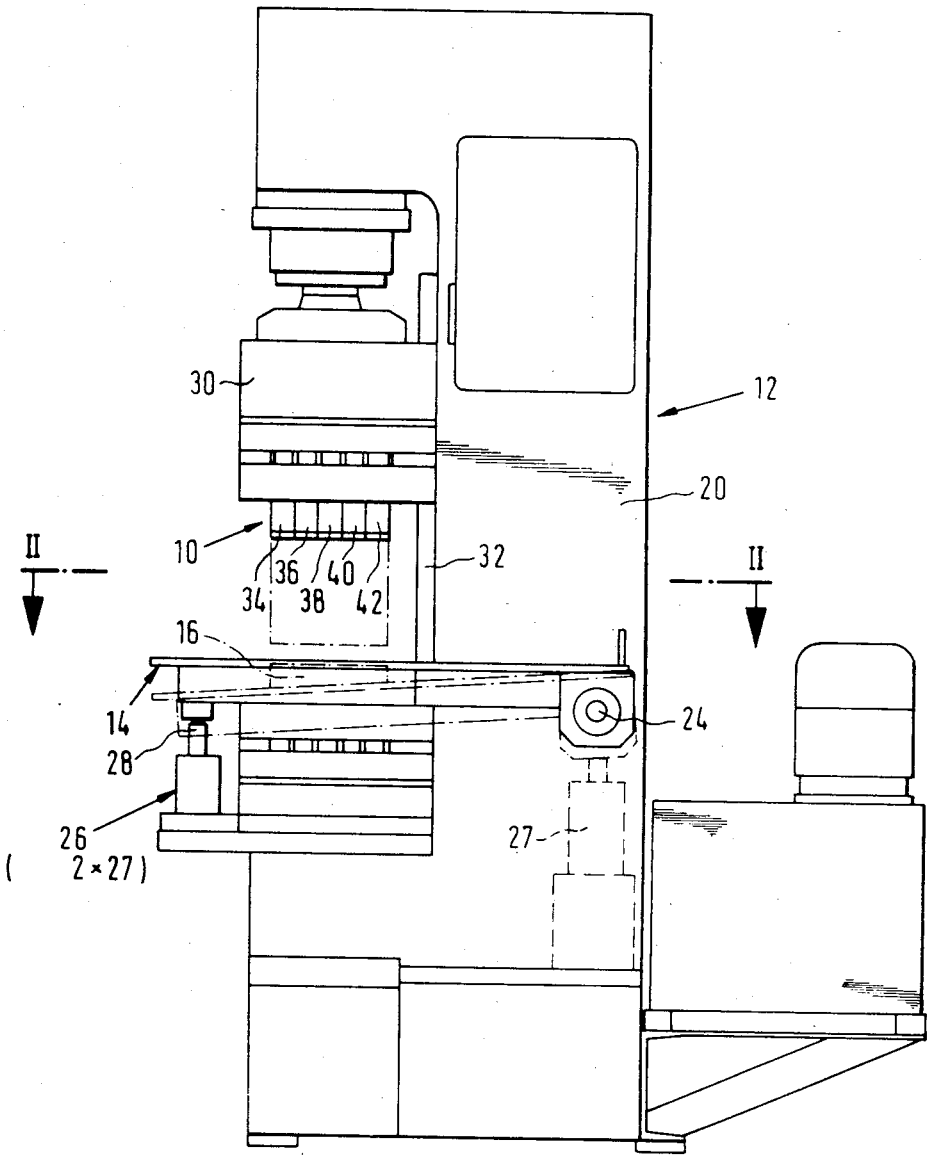
FIG. 1 is a side elevational view of a stone cutting apparatus in accordance with the present invention.
Figure 2:
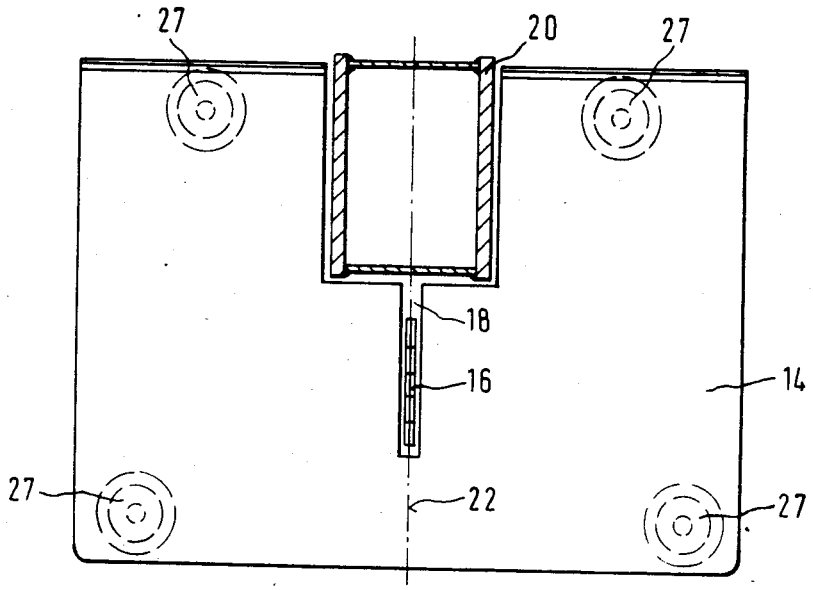
FIG. 2 a sectional elevation of the cutting apparatus according to FIG. 1 along line A—A in FIG. 1.
Figure 3:
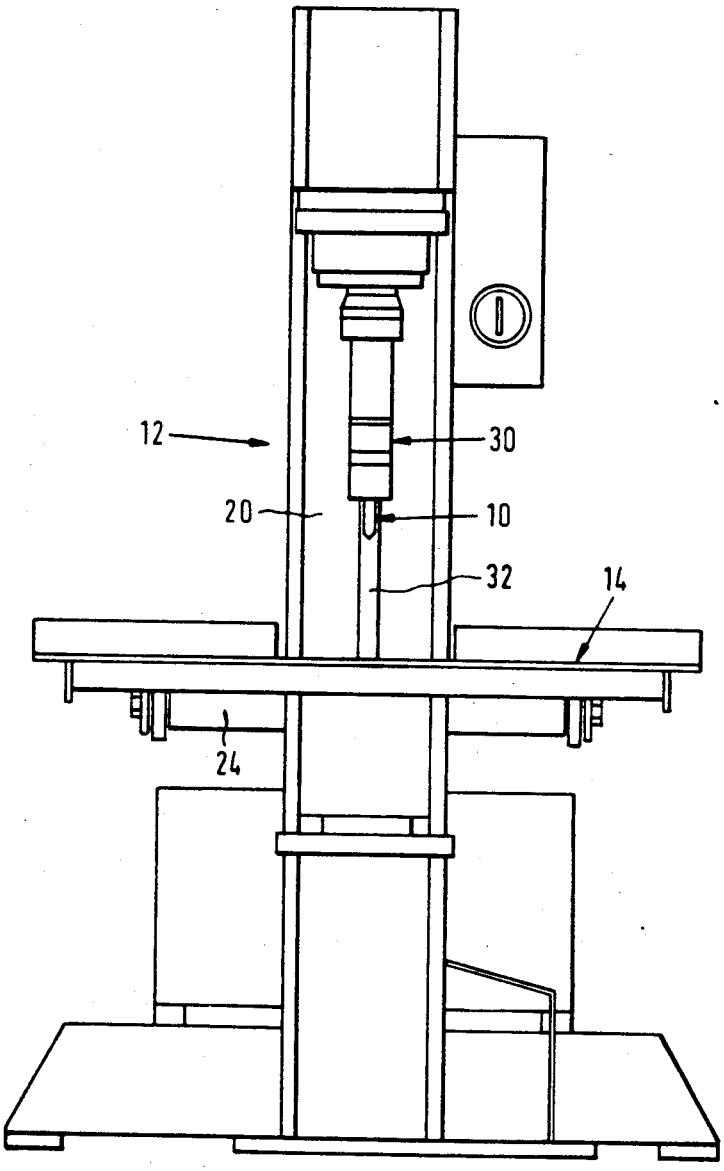
FIG. 3 a front elevational view of the cutting apparatus according to FIG. 1.

The pavement and masonry stone cutter diagrammatically shown in FIGS. 1 to 3 consists of a C-shaped frame 12, preferably made as a welded sheet steel lattice structure of good capability to take up the forces generated during the cutting process. Undue bending of the vertical post or girder need not be feared if the inner ribs are made sufficiently sturdy.

At the lower side of the upper leg or transverse beam of the C-shaped frame or post 12 a tool holder 30 for an upper tool 10 is secured in such manner that it can be moved up and down vertically together with the upper tool. The tool holder 30 is guided either by means of a linear bearing 32 disposed at the inside of the upright frame column 20 or by guide bearings disposed at either front end of the frame column 20.

Figure 4:
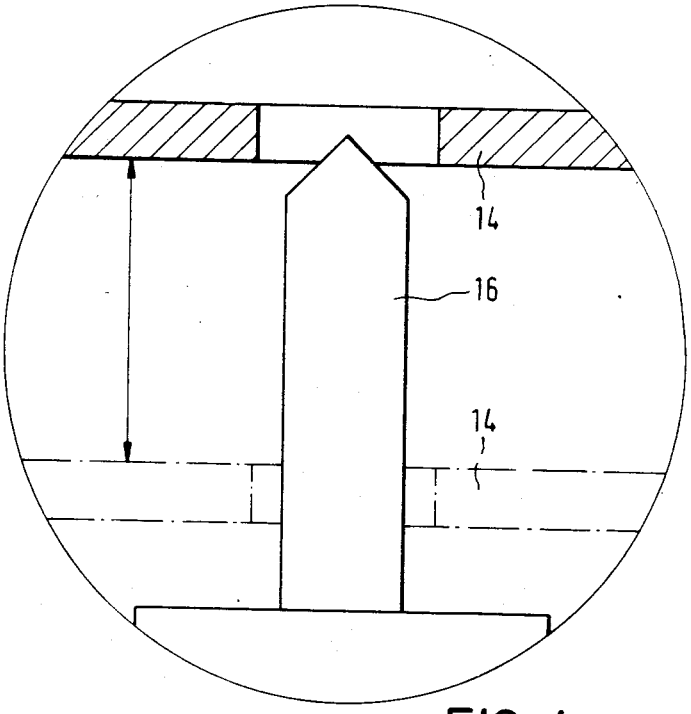
FIG. 4 a detail of the lower cutting tool of the cutting apparatus according to FIG. 3, on an enlarged scale.

A lower tool 16 of corresponding design is associated with the upper tool 10 which is movable up and down, the lower tool being disposed below the worktable 14. The worktable 14 is formed with a slot-like opening 18 in the area of the lower tool 16. The worktable 14 is mounted on the vertical frame column 20 for pivotting movement about a pivot axis 24 extending horizontally and perpendicularly to the center plane of the C-shaped frame or post 12. The end of the worktable 14 disposed opposite the pivot axis 24 is supported on the piston rod 28 of an hydraulic piston and cylinder unit 26. When cutting a stone pushed into the area between the upper tool 10 and the lower tool 16 the piston and cylinder unit 26 is deactivated in controlled manner whereby the worktable 14 is tilted in downward direction about the pivot axis 24 under the pressure exerted by the cutting tool 10 on the stone material, thus adopting a position shown in dash-dot lines in FIG. 1. On this occasion the lower tool 16 which is stationary in the frame 12 passes through the slot 18 of the worktable 14 and projects beyond the working surface of the worktable 14. The upper tool 10 and the lower tool 16 thus enter into cutting operation at the same time. FIG. 4 shows the relative positions between the worktable 14 and the stationary lower tool 16 in detail and on an enlarged scale (scale 1:1).

Figure 3A:
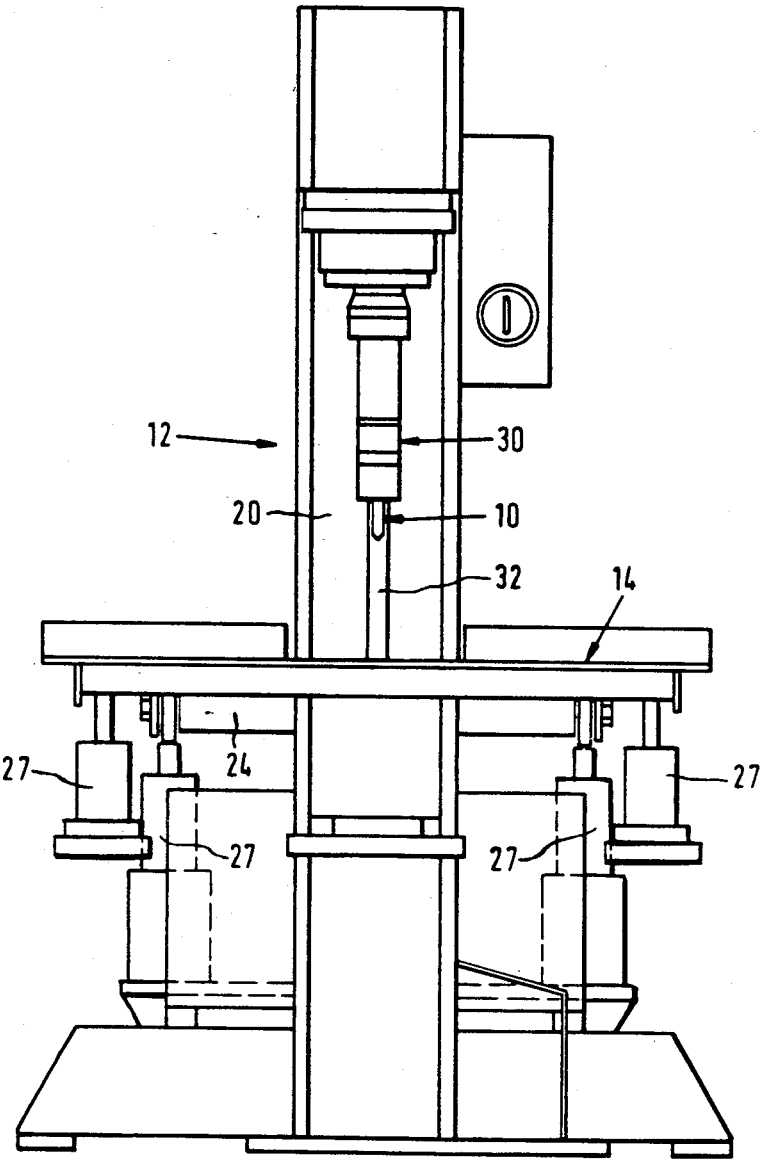
FIG. 3A is a front elevational view of another arrangement similar to FIG. 3.

The vertical relative movement of the worktable 14 may also be obtained by a structure shown in FIG. 3A. The worktable is supported on four piston and cylinder units 27 each disposed in a corner and each being deactivated in controlled fashion during the cutting so that the worktable may be lowered substantially only be the cutting force acting on the stone material—independently of the stone weight—, and the lower tool 16 may enter into cutting operation.

It is also conceivable to maintain the pivot axis 24 of the structure described last and to support it by at least two hydraulically, pneumatically or hydropneumatically controlled thrust bearings 27. This is advantageous, for example, if the worktable at the same time is to be used as a slide plate for cut stone. In that case the worktable preferably tilts towards the rear so that the cut stone material does not obstruct or endanger the workman standing in front of the apparatus.

As shown in FIGS. 1 to 4, the cutting tools are of knife- or wedge-like design (cleaving wedges).

The tilting and lowering movements of the worktable 14 described above are forced movements at the cycle of the upper tool 10 which is adapted to reciprocate in vertical direction. During the return stroke of the upper tool 10 thus the table is lifted and swung up into its horizontal position. Then the stone material may be displaced and positioned easily on the table plate. By virtue of these kinematics the apparatus according to the invention may be coupled very well with an automatic stone material supply means, such stone supply preferably being effected at the same cycle at which the cutting tool or upper tool works.

It may be taken from the above statements that it is of great importance in connection with the apparatus of the invention that the stone material to be cut may be displaced and positioned without any obstruction on the working table 14 above the lower tool 16 between the cutting phases and that during the cutting the upper and lower tools simultaneously act on the stone material. This permits accurate cleaving at a minimum expenditure of energy and simple and particularly riskless handling.

A suitable throttle, preferably controlled by the hydraulic system of the upper tool is provided in the outlet of the piston and cylinder unit 26 open during deactivation. In this manner better coordination is obtained between the movements of the upper tool 10 and of the worktable 14 which is adapted to be tilted about the pivot axis 24 or lowered. The throttle effect is variable in response to the stone material to be cut or split.

In the embodiment shown in FIGS. 1 to 4 the upper tool 10 is driven hydraulically and this drive is of such design that upon surpassing of a certain predetermined force of reaction acting on the upper tool, the latter yields in the direction of the same, i.e. in upward direction. Preferably the hydraulic system may be so designed that the immediate return stroke of the upper tool is initiated if there is a sudden rise in pressure. In this manner breaking of the tool knife edges of the upper tool 10 and of the lower tool 16 can be avoided to a great extent if the forces of reaction are too great (overload protection).

The structural solution of the above problem is simple in that a hydraulic valve is provided in the outlet of the piston and cylinder unit associated with the upper tool or with the tool holder 30. This valve may be moved into reverse position for the return stroke of the upper tool 10, the switch-over being effected in response to the pressure acting in the hydraulic system (pressure switch, if desired, with electrical signal conversion).

As regards the hydraulic control unit it should be mentioned, in general, that the infeed of the upper tool preferably is effected in the low pressure range, while only the cutting work proper in done in the high pressure range of up to about 500 bar, and the return stroke of the cutting tool is effected generally in the low pressure range. The switch-over from low pressure to high pressure may be sudden by virtue of the tool design of the invention.

The hydraulic system, furthermore, is so designed that the return stroke of the upper tool 10 is initiated also when the pressure drops suddenly. A sudden pressure drop means that the stone material is cut.

A preferred hydraulic arrangement for the harmonized movements of the upper tool holder 30 for the upper tool 10 and the supporting table 14 or the piston and cylinder units 26 and 27 supporting the worktable will now be described with reference to FIG. 8.

Figure 8:
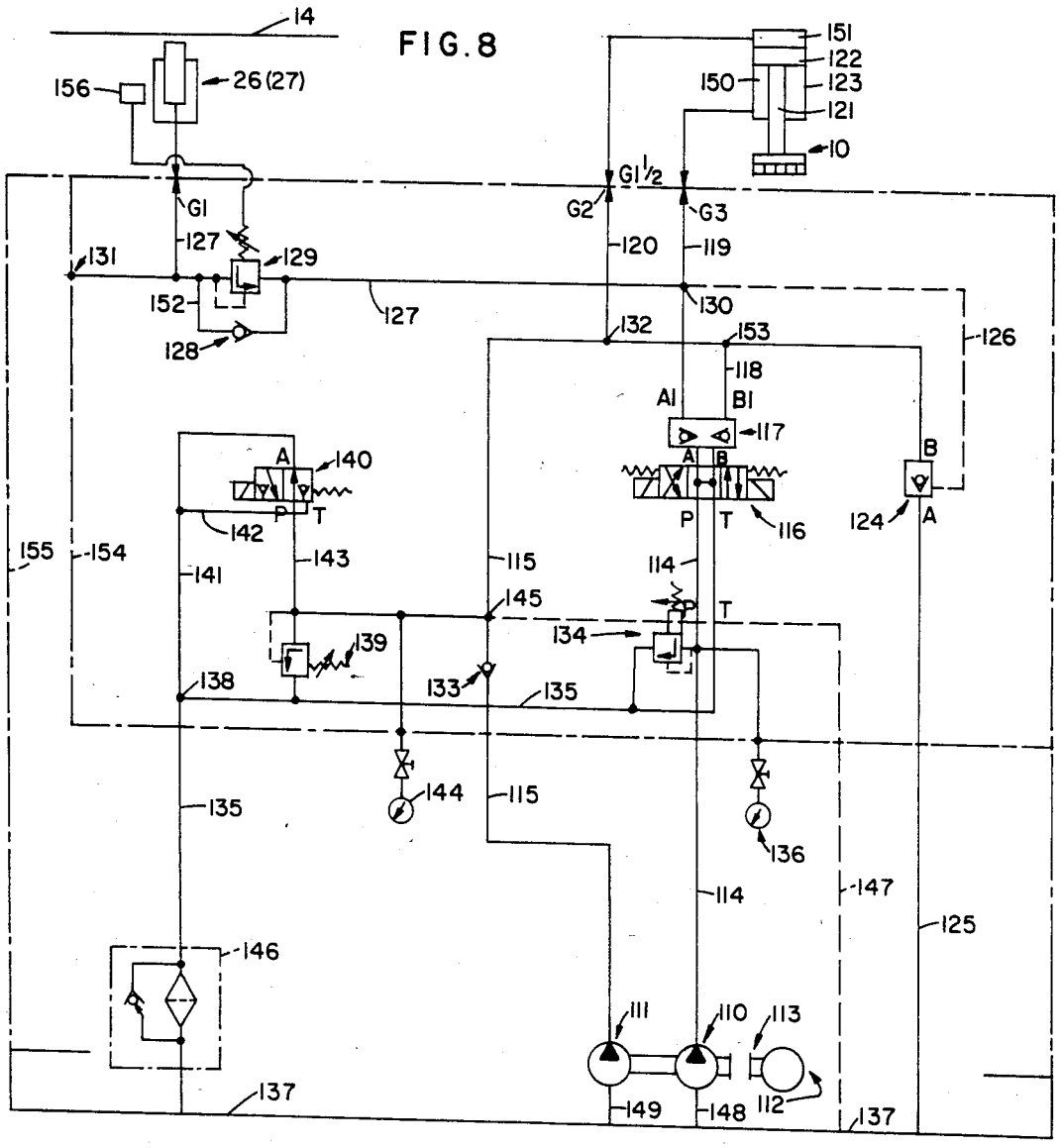
FIG. 8 a schematic diagram of the hydraulic circuits employed with the apparatus of the present invention.

As shown diagrammatically in FIG. 8 the hydraulic arrangement for a cutter of the kind described comprises a hydraulic pump which is divided into a low pressure part 110 and a high pressure part 111. The pump is connectable to a motor 112, preferably an electric motor by means of a shifting clutch 113. The low and high pressure parts 110 and 111 each are in fluid communication with a tank 137 by way of suction lines 148 and 149, respectively. A low pressure flow line 114 is connected to the low pressure part 110 of the pump and it includes a 3/4-way valve 116 and a twin check valve 117 connected to the same. These two valves provide alternative fluid communication between the low pressure flow line and two cylinder chambers 150 and 151 of a piston and cylinder unit 122, 123 which is adapted to be pressurized from two sides. This piston and cylinder unit serves to drive the upper tool 10 of the cutter described and comprises a cylinder 123 in which a piston 122 is supported for reciprocating up and down movement. A piston rod 121 is connected to the piston 122 at the side facing the upper tool 10 and it projects out of the corresponding front end of the cylinder 123 for the purpose of connection to the top of upper tool holder 30. The cylinder chamber through which the piston rod 121 extends is designated 150, while the opposed cylinder chamber is marked by reference numeral 151. The connecting line between the twin check valve 117 and the cylinder chamber 150 of cylinder 123 through which, as already mentioned, the piston rod 121 extends, is marked by reference numeral 119, while the connecting line between the twin check valve 117, on the one hand, and the cylinder chamber 151 remote from the piston rod is marked by reference numerals 118, 120. The connecting line 119 serves as a tool lifting line, while connecting line 120 is a tool lowering line adapted to be pressurized alternatively by low pressure or high pressure. This will be explained in greater detail below in the description of the operation. The connecting line 119 which serves for lifting of the tool and is adapted to be pressurized only by low pressure is in fluid communication through a junction 130 and a connecting line 127 with the supporting piston and cylinder units 26 and 27 described above. A pressure limiting valve 129 in the form of an adjustable pressurizing valve is connected in the connecting line 127 and designed as an adjustable throttle which can be bypassed by a bypass line 152. The bypass line 152 contains a check valve 128 which closes as the supporting table 14 associated with the piston and cylinder units 26 and 27 is lowered. For purposes of control a pressure gauge 131 is associated with the connecting line 127 between the pressure limiting valve 129 in the form of a throttle and the piston and cylinder units 26 and 27.

A return line 126 by which a check valve 124 located in a tank return line 125 is adapted to be opened hydraulically is connected to the junction 130. The tank return line 125 is in fluid communication with the hydraulic connecting line 118, 120 through a junction 153. The hydraulic connecting line 118, 120 also is in fluid communication with the high pressure part 111 of the pump by way of a junction 132 and a high pressure flow line 115 to prevent any return flow to the high pressure part 111 of the pump.

The low pressure flow line 114 leads to the connection "P" of the 4/3-way valve 116. A return line 135 leads from the connection "T" of this valve to the tank 137 through a return filter 146. A pressure sensitive connecting valve 134 is positioned between the low pressure flow line 114 and the return line 135. A pressure gauge 136 for checking the fluid pressure is provided where the valve 134 is connected to the low pressure flow line 114.

A fluid line 143 is connected to the high pressure flow line 115 between the check valve 133 and the junction 132. By a 3/2-way valve 140 and another line 141 this fluid line 143 is connected to the return line 135 coming from connection "T" of the 4/3-way valve 116 (junction 138). Between the 3/2-way valve 140 and the junction 145 with the high pressure flow line 115 the fluid line 143 is adapted to be connected through a high pressure limiting valve 139 to the return line 135. A pressure gauge 144 for optical determination of the pressure is connected to the fluid line 143 between the connection of the pressure limiting valve 139 and the junction 145. Between the 3/2-way valve 140 and the junction 138 with return line 135 the line 141, finally, may be connected by a connecting line 142 either to the connection "T" (tank) or "P" (pump), in response to the switching position of the 3/2-way valve 140. The 3/2-way valve 140 has but a single outlet "A" to which the line 141 is connected.

The 4/3-way valve 116 has two outlets "A" and "B" and a twin check valve 117 is associated with each of them so that return flow to the 4/3-way valve 116 can be prevented. The fluid connecting lines 119 and 118, 120, respectively connected to the twin check valve 117, are associated with the outlets "A" and "B" of the 4/3-way valve 116.

A return line 147 leads from junction 145 to tank 137. The above mentioned pressure sensitive connecting valve 134 is effective in this return line 147 such that the line 147 is closed when a given low pressure, for instance of 30 bar, is surpassed in the low pressure flow line 114. This is the case, for example, when the upper tool 10 has been moved under low pressure against the stones to be cut against it now abuts. In this event, the high pressure existing in high pressure flow line 115 abruptly becomes effective in the cylinder chamber 151. Hereby the stone is split. At the same time the supporting table 14 is lowered against the action of the pressure prevailing in connecting line 127. Hereby the pressure in connecting line 127 becomes so high that the check valve disposed in the return line 125 is opened by way of the junction 130 and the return line 126. This causes an abrupt drop of the high pressure in the high pressure flow line 115 and the connecting line 120. The high pressure fluid flows through the hydraulically released return valve 124 and the return line 125 back to the tank 137. The return stroke of the upper tool 10 then may be initiated at a corresponding position of the 3/4-way valve 116 through the low pressure connecting line 119. To this end fluid communication is established between the low pressure flow line 114 and the tool lifting connecting line 119 by way of the 4/3-way valve 116. In FIG. 8 this corresponds to a position "P-A" of the 4/3-way valve 116, whereas the low pressure adjustment of the upper tool 10 is effected with the 4/3-way valve 116 in position "P-B". In FIG. 8 the outputs of the twin check valve 117 are marked "$A_1$" and "B" of the 4/3-way valve 116.

A fully mounted, control valve block or mounting frame is indicated diagrammatically by the discontinuous lines 154, 155. The mounting frame according to line 155 comprises three hydraulic connections or couplings G1, G2 and G3 to establish hydraulic connections with connecting lines 119, 120 and 127. The operation of the hydraulic arrangement described above will now be explained briefly.

The upper tool 10 mounted on the tool holder 30 is moved under low pressure to the stone to be cut which is positioned on the supporting table 14 above the lower tool. To this end the low pressure flow line 114 is connected to the cylinder chamber 151 of the piston and cylinder unit 122, 123 remote from the upper tool or on the side of the piston opposite the piston rod by way of the 4/3-way valve 116, through outlet "B", and the check valve of the twin check valve 117 associated with the same. The low pressure action at the side of the piston 122 opposite the piston rod causes the piston and consequently the upper tool 10 to be lowered or moved against the stone to be cut. The fluid or hydraulic medium inside the cylinder chamber 150 through which the piston rod 121 passes will escape through connecting line 119 and return lines 126, 125 into the tank 137. As the upper tool 10 is moved toward the stone to be cut which is positioned on the supporting table 14, the highly pressurized fluid will flow from the high pressure part 111 of the hydraulic pump through the high pressure flow line 115 and the check valve 133 arranged in this line and by way of the junction 145 through the open return line 147 back to the tank 137. As soon as the upper tool 10 engages the stone arranged for cleaving, the pressure in low pressure flow line 114 rises above a given pressure determined by the pressure sensitive connecting valve 134. As a consequence, a valve positioned in return line 147 will be closed so that the high pressure existing in the high pressure flow line becomes effective abruptly through this line, junction 132, and connecting line 120 which leads to the cylinder chamber 151. The upper tool 10 exerts a corresponding pressure on the stone to be cut, thus cleaving the same. This will result in a minor lowering of the supporting table 14 against the action of the supporting hydraulic piston and cylinder units 26 and 27. Accordingly, higher pressure builds up in the connecting line 127 leading to these supporting units, and thus the pressure limiting valve 129 arranged in the connecting line 127 is opened. Through junction 130 and return line 126 this higher pressure also acts on the hydraulically releasable check valve 124, opening the same so that the high pressure prevailing in high pressure flow line 115 and connecting line 120 as well as in return line 125 leading back to the tank 137 again can be decreased abruptly. Thus the cutting process is terminated.

Subsequently the upper tool is moved back into its raised starting position. This return movement takes place under low pressure. The 4/3-way valve 116 is manually switched accordingly so that the low pressure part 110 of the hydraulic pump will be connected through low pressure flow line 114 to connecting line 119 which leads to cylinder chamber 115 through which the piston rod passes. Thus the piston 122 is moved in upward direction, taking along the upper tool 10. At the same time the low pressure is admitted through junction 130 and connecting line 127, bypass line 152, and return valve 128 disposed in this line to the hydraulic supporting piston and cylinder units 26 and 27, whereby the supporting table 14 again is moved into its raised starting position. The fluid escaping from cylinder chamber 151 flows back into the tank 137 through connecting line 120 and tank return line 125. During the return stroke of the piston 122 or the upper tool 10 into the upper starting position the 3/2-way valve is in open position "T" toward the tank, as shown in FIG. 8. This guarantees a pressureless circulation in the high pressure part. Otherwise the 3/2-way valve is closed. Upon overload of line 143 under high pressure the pressure limiting valve 139 opens toward the return line 135, for instance, at a fluid pressure of approximately 315 bar. As soon as piston 122 and upper tool 10 have reached their upper starting position, the pressure in low pressure flow line 114 rises above the pressure determined by the pressure connecting valve so that the latter is opened and the low pressure fluid now may flow back into the tank 137 through line 135 and return flow filter 146. The pressure limiting valves 139 and 129 are variable. Conveniently the pressure limiting valve 129 is an adjustable pressurizing valve used as a variable throttle so as to permit adaptation of the lowering motion of the supporting table 14 to different degrees of hardness and different weights of the stones as well as to different cutting forces. This pressure limiting valve is adapted to be deactivated upon surpassing of a predetermined pressure, i.e., it opens when this pressure acting on the piston and cylinder units 26 and 27 exceeds a selected amount. The lowering movement of the upper tool 10 then is initiated again, if required, in accordance with the above description.

The pressure limiting valve 129 in the form of this pressurizing valve preferably is variable in response to a weight sensor 156 disposed below the supporting table 14. The weight sensor 156 conveniently is associated with the hydraulic supporting piston and cylinder unit 26 or 27 and connected mechanically or, preferably, hydraulically with the pressure limiting valve 129 so that for example a biasing spring will be influenced in correspondence with the weight. This influence may be exerted with the help of a pressure amplifier. Throttling in the area of the pressurizing valve is obtainable by so-called proportional control valves.

If a plurality of hydraulic supporting units are provided, a weight sensor preferably is associated with each one of them, as explained, so that the supporting table 14 may be supported and lowered in response to the distribution of the weight.

It is also possible to associate a preselector switch with the pressurizing valve to provide several pressurizing ranges in correspondence with the respective stone material to be cut, e.g., "limestone", "sandstone", "granite", "marble", etc. The pressurization of the pressure limiting valve 129 then would be adjusted manually in correspondence with the respective stone to be cut whereby the supporting and lowering movement of the worktable would be adjusted in accordance with experience.

Figure 5:
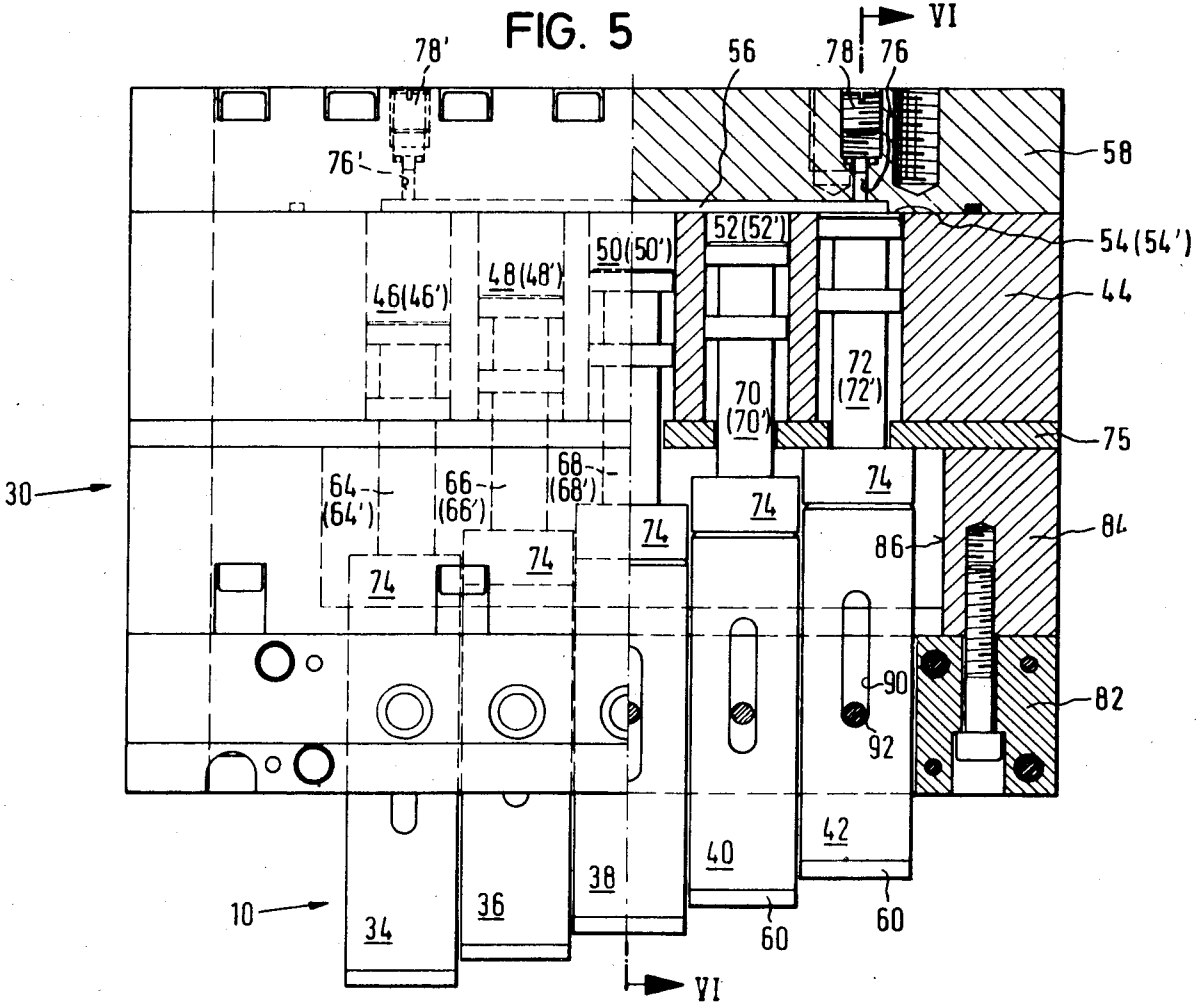
FIG. 5 a part elevational and part sectional view of the cutting tool (upper tool), on an enlarged scale.
Figure 6:
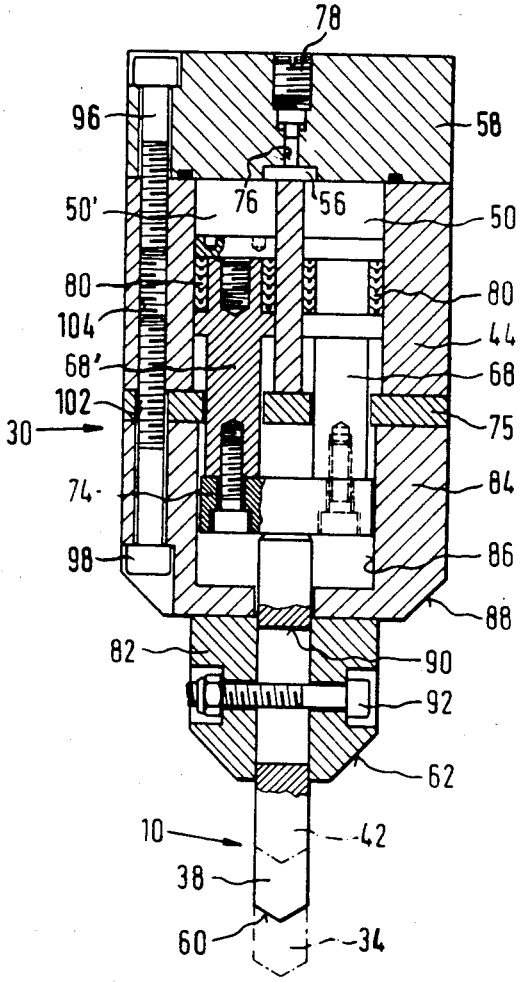
FIG. 6 a sectional elevation of the cutting tool (upper tool) according to FIG. 5, along line VI—VI.
Figure 7:
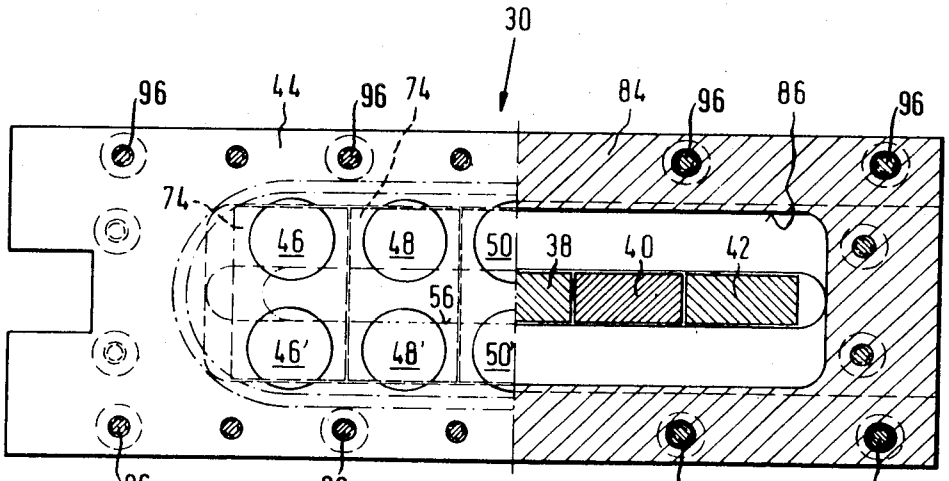
FIG. 7 the cutting tool (upper tool) according to FIG. 5 without the cylinder head, partly in top plan view and partly in section.

As may be seen in FIGS. 5 to 7, the upper tool 10 consists of five individual tools (cleaving wedges) 34, 36, 38, 40, 42 which are movable with respect to one another. In this manner optimum adaptation may be obtained of the upper tool to natural cleft uneven stone surfaces. The individual cleaving wedges 34–42 are supported in a common cylinder body 44 forming part of the tool holder 30 in a manner to be displaceable in cutting or acting direction of the upper tool. The cylinder chambers 46, 46', 48, 48', 50, 50', 52, 52', 54, 54' associated with the individual cleaving wedges and preferably filled with oil, being in fluid communication with one another. As may be gathered from FIGS. 6 and 7 two cylinder chambers are associated with each individual cleaving wedge. The upper sides of the cylinder chambers are covered by a cylinder head 58. At the bottom side or the side of the cylinder head 58 facing the cylinder chambers a groove 56 is formed to constitute the fluid connection between the cylinder chambers. This fluid connection 56 establishes a balance between the different oil volumes displaced in the cylinder chambers by the pistons associated with the individual cleaving wedges. At the same time uniform pressure distribution is obtained as regards each individual cleaving wedge. In FIGS. 5 and 6 the pistons are marked by reference numerals 64, 64', 66, 66', 68, 68', 70, 70', 72, 72'. The width and depth of the groove 56 are so dimensioned that "spontaneous" fluid balance may be effected between the individual cylinder chambers upon uneven loading of the individual cleaving wedges. (Width of the groove approximately corresponding to half the diameter of the cylinder, depth of the groove corresponding to approximately ($\frac{1}{2}$–$\frac{1}{4}$) groove width).

Charging and discharging of the cylinder chambers 46, 46' . . . 54, 54' is effected through two conduits 76, 76' opening into the groove 46 and adapted to be closed by sealing screws 78, 78'. As shown in FIGS. 6, a pressure piece each in the form of a pressure plate 74 is disposed between the individual cleaving wedges 34–42 and the hydraulic pistons 64, 64' . . . 72, 72' supported for displacement in the corresponding cylinder chambers 46, 46' . . . 54, 54'. In this manner the double piston associated with each individual cleaving wedge is subjected to uniform pressurization. In cooperation with a hydraulic piston guide plate 75 which closes the lower side of the cylinder chambers and through which the hydraulic pistons pass that are connected rigidly with the pressure plates 74 the latter act as a limit for movement of the individual cleaving wedges in upward direction. In the opposite direction the movement of the individual cleaving wedges is limited by direct cooperation of the hydraulic pistons and guide plate 75.

The pistons 64, 64' . . . 72, 72' are sealed in conventional manner with respect to the inner wall of the associated cylinder chambers (automatic arched sealing boots 80).

The individual cleaving wedges 34–42, in addition, are supported and held in a tool receiving body 82 disposed below the cylinder body 44. The lower side of the tool receiving body 82 facing the stone material or the cutting edge 60 of the individual cleaving wedges is formed with inclined edges 62 for easy slide-off of the cut stone material. An intermediate piece 84 having a recess 85 within which the pressure plates 74 may move up and down is positioned between the tool receiving body 82 and the cylinder body 44 or the piston guide plate 75. In a manner corresponding to the lower side of the tool receiving body 82 also the lower side of the intermediate piece 84 has inclined edges 88. The intermediate piece 84, the piston guide plate 75, the cylinder body 44, and the cylinder head 58 are firmly connected by screws 96, 98. These screws extend through corresponding through bores 100, 102, 104 in the cylinder head, the piston guide plate which at the same time fulfills a sealing function, and the intermediate piece, and they are screwed into internal threads 104 formed in the cylinder body 44 and each aligned with the respective through bores.

As FIGS. 5 and 6 show, the individual cleaving wedges 34–42 each are formed with an oblong hole 90 through which a threaded bolt 92 passes in transverse direction. In combination with the threaded bolt 92 the oblong hole 90 serves as means of suspension for the individual cleaving wedges. Preferably the individual cleaving wedges may become displaced in vertical direction by approximately 40 mm with respect to the tool holder 30.

At least one dust suction means, preferably working with wide slot nozzles is provided in the cutting range between the upper tool 10 and the lower tool 16 to improve the working conditions.

It goes without saying that the lower tool may be designed in the same manner as the upper tool as shown in FIGS. 5 to 7. This would provide additional improvement of the cutting precision. Furthermore, the specific loading of the knife edges 60 of the cutting tool is reduced to a minimum. It should be mentioned expressly that the cutting tool described can be employed also in other types of cutting apparatus, e.g. in an apparatus having a double post frame according to U.S. Pat. Nos. 4,203,414.

All the features disclosed in the documents are claimed as being essential of the invention, provided they are novel either individually or in combination when compared with the state of the art.

What is claimed is:

1. A pavement and masonry stone cutter apparatus comprising an upper tool drive so as to reciprocate in a frame and cooperating with a lower tool, said upper and lower tools each comprising a plurality of individual cleaving wedges which are movable relative to one another in a cutting direction, at least one of said upper and lower tools being movable in response to a pumped fluid, improvement comprising said frame being C-shaped and including a supporting table having a slot-like opening for passage of said lower tool, said apparatus including a fluid operated piston and cylinder unit with said unit including a piston rod, said supporting table having an inner end which is pivotably mounted on said C-shaped frame and an outer end supported by means of said rod of said fluid operated piston and cylinder unit for moving said supporting table down during a cutting operation and moving said table up again to a starting position upon the completion of a cutting operation, said movement upward to said starting position of said supporting table corresponding to the return movement of said upper tool, said lower tool being positioned below the top of said supporting table when said supporting table is in said starting position, said piston and cylinder unit being associated with fluid system including a pressure limiting valve for deactivating said unit in a controlled manner during a cutting operation whereby said supporting table is tilted in a downward direction regardless of the weight of the rock to be cut, said piston and cylinder unit for said supporting table being actuatable to raise said table to its starting position after said cutting operation so that said lower tool will lie below the surface of said supporting table.

2. The apparatus as claimed in claim 1 wherein said lower tool is mounted stationarily in said C-shaped frame.

3. The apparatus as claimed in claim 1 wherein said lower tool is mounted for vertical up and down movement relative to said C-shaped frame.

4. The apparatus as claimed in claims 1, 2 or 3 wherein said supporting table is supported on a vertical column of said C-shaped frame for pivoting movement about a pivot axis which extends approximately horizontally and perpendicularly to the vertical column of said C-shaped frame.

5. The apparatus as claimed in claim 1 wherein said fluid system includes adjustable throttling means which is open to permit fluid flow when said piston and cylinder unit are deactivated.

6. The apparatus as claimed in claim 1 wherein said fluid system includes valve means for delivering fluid to said piston and cylinder unit and to said upper tool whereby the lifting and lowering of said supporting table will follow the movement of said upper tool.

7. The apparatus as claimed in claim 1 wherein at least three piston and cylinder units are provided for pivoting said supporting table.

8. The apparatus as claimed in claim 1 wherein said upper tool is connected to said fluid system and said fluid system is hydraulically actuated.

9. The apparatus as claimed in claim 1 wherein said upper tool is movable in a return stroke which is adjustable to compensate for different stone heights and shapes and user operated means are provided for stopping the return stroke of said upper tool at a selected point.

10. The apparatus as claimed in claim 1 wherein said upper tool includes a tool holder and said frame includes a vertical column including means for guiding vertical movement of said tool holder, said means including a linear bearing member.

11. The apparatus as claimed in claim 1 wherein at least one of said tools is yieldable in the direction of the force acting upon it so as to avoid breakage of said respective tool.

12. The apparatus as claimed in claim 1 wherein said fluid system includes a pressure sensitive valve means for controlling the operation of one of said tools during a stone cutting operation upon said one tool being first moved to engage a stone.

13. A cutter as claimed in claim 1 wherein said upper tool includes a plurality of cleaving wedges each having one end supported for displacement in a cylinder chamber which is filled with an incompressible fluid, said cylinder chambers being in fluid communication with one another and each having a cylinder head displaceably mounted therein.

14. The cutter as claimed in claim 13 wherein two cylinder chambers are associated with each individual cleaving wedge and a flow communication groove is provided for establishing fluid communication between said cylinder chambers through said groove, said cutter including a cutter head space, said groove being located on a side of said cylinder head space facing said cylinder chambers.

15. The cutter as claimed in claim 14 wherein each said cylinder chamber is provided with a stop means for limiting the motion of each individual cylinder head cleaving wedge.

16. The cutter as claimed in claim 13 wherein each said cylinder head has a piston rod extending therefrom towards said cleaving wedge, said stop of each said cleaving wedge including a piston guide means through which said piston rods are reciprocably mounted in said cylinder chambers.

17. The invention as claimed in claim 16 wherein each said piston rod includes an extension to limit the length of travel of each said piston in said respective cylinder chambers.

18. The cutter as claimed in claim 17 wherein a pair of cylinders is provided for each cleaving wedge with each cylinder having a piston head and a piston rod extending therefrom with each pair of piston rods being connected securely to a common pressure plate member.

19. The invention as claimed in claim 13 where each said cleaving wedge has a longitudinal axis and an oblong opening formed along said axis for receiving a retaining bolt.

* * * * *